US007328964B2

(12) United States Patent
Sakai et al.

(10) Patent No.: US 7,328,964 B2
(45) Date of Patent: Feb. 12, 2008

(54) IMAGE PROCESSOR, IMAGE PROCESSING METHOD, PRINTER, PRINTING METHOD, PROGRAM, AND RECORDING MEDIUM

(75) Inventors: Hiroaki Sakai, Chino (JP); Toru Takahashi, Matsumoto (JP)

(73) Assignee: Seiko Epson Corporation (JP)

( * ) Notice: Subject to any disclaimer, the term of this patent is extended or adjusted under 35 U.S.C. 154(b) by 110 days.

(21) Appl. No.: 11/339,707

(22) Filed: Jan. 25, 2006

(65) Prior Publication Data

US 2006/0170722 A1 Aug. 3, 2006

(30) Foreign Application Priority Data

Jan. 28, 2005 (JP) ..... 2005-020841
Sep. 30, 2005 (JP) ..... 2005-288875

(51) Int. Cl.
*B41J 29/393* (2006.01)

(52) U.S. Cl. ..... 347/19; 347/14; 347/15

(58) Field of Classification Search ..... 347/19, 347/40–43, 15

See application file for complete search history.

(56) References Cited

U.S. PATENT DOCUMENTS 5,581,284 A * 12/1996 Hermanson ..... 347/43
6,283,571 B1 9/2001 Zhou et al.
6,293,643 B1 9/2001 Shimada et al.
6,328,404 B1 12/2001 Fujimori
6,776,474 B2 * 8/2004 Yang et al. ..... 347/43
6,908,176 B2 * 6/2005 Koitabashi et al. ..... 347/43
7,168,782 B2 * 1/2007 Koitabashi et al. ..... 347/19

FOREIGN PATENT DOCUMENTS

| | | |
|---|---|---|
| JP | 01-235655 | 9/1989 |
| JP | 11-048462 | 2/1999 |
| JP | 11-151821 | 8/1999 |
| JP | 11-254662 | 9/1999 |
| JP | 2000-79710 | 3/2000 |
| JP | 2000-190470 | 7/2000 |
| JP | 2000-225716 | 8/2000 |

* cited by examiner

*Primary Examiner*—Thinh Nguyen
(74) *Attorney, Agent, or Firm*—Harness, Dickey & Pierce, P.L.C.

(57) ABSTRACT

An image processor for a printer that forms an image on a medium by discharging N types (N is a natural number of 2 or more) of ink having different densities for at least one color system from respective nozzles includes a printing image data generator for generating printing image data based on image data, a printing image data output unit for outputting the printing image data, a nozzle information acquisition unit for acquiring information on the nozzles, and a substitute unit that, when a bad nozzle is found in the nozzle information, substitutes a nozzle, which discharges another type of ink among the N types of ink, for the bad nozzle.

9 Claims, 10 Drawing Sheets

IMAGE PROCESSOR, IMAGE PROCESSING METHOD, PRINTER, PRINTING METHOD, PROGRAM, AND RECORDING MEDIUM

RELATED APPLICATIONS

The present application claims priority to Japanese Patent Application Nos. 2005-020841 filed Jan. 28, 2005 and 2005-288875 filed Sep. 30, 2005 which are hereby expressly incorporated by reference herein in their entirety.

BACKGROUND

1. Technical Field

The present invention relates to an image processor, an image processing method, a printer, a printing method, a program, and a recording medium, which can suppress the occurrence of banding such as a white line or dark line due to a flying bend in a nozzle during printing by discharging ink from the nozzle.

2. Related Art

There has been known a printer that has a recording head for discharging ink, and performs printing by forming dots on a medium such as paper, cloth and plastic, or a transparency (hereinafter, simply called recording paper) by discharging the ink to the medium.

This type of printer is configured in a manner that a plurality of nozzles are formed in the recording head, and ink is discharged from the nozzles, however, in one or more of the nozzles, a discharge direction of the ink may be deflected, causing a shift in the landing position of a dot, and a so-called flying bend may occur. In this case, there is a problem that, for example, when a uniform pattern image is printed, a white line (so-called banding) appears in a printed image, which degrades printing quality.

Hereinafter, a printer, particularly a printer employing an inkjet method (hereinafter, referred to as "inkjet printer") is described.

Generally, inexpensive and high-quality color prints are easily obtained from inkjet printers and therefore inkjet printers have been widely used not only at an office but also by a general user with the widespread use of personal computers and digital cameras.

Such an inkjet printer is typically formed in a way that a movable body called carriage, which integrally includes an ink cartridge and an ink head, discharges (ejects) particles of liquid ink in a dotted form from nozzles in the printing head while reciprocating across a printing medium (paper) in a direction perpendicular to a feed direction relative to the paper, thereby predetermined letters or images are drawn on the printing medium to make a desired print. The carriage typically includes ink cartridges of four colors including black (black, yellow, magenta, and cyan) and printing heads for respective colors, so that not only monochrome printing but also full-color printing can be easily carried out by combining respective colors (furthermore, a printer of six colors, seven colors, or eight colors formed by adding light cyan, light magenta and the like to the colors is now practically used).

In such an inkjet printer (where the printing head on the carriage performs printing while reciprocating in the direction perpendicular to the paper feed direction), since the printing head needs to be reciprocated dozens of times to one hundred times or more to finely make prints on a full page, there is a drawback in that an extremely long printing time is required as compared with other types of printers such as a laser printer using an electrophotographic technique like a copier. This type of inkjet printer is generally called a "multipass printer" or "serial printer".

On the contrary, in an inkjet printer with a long-size printing head having a size equal to (or longer than) the width of the printing paper disposed so that a carriage is not used, the printing head need not be moved in a lateral direction relative to the printing paper, and a so-called one scan (one pass) printing is possible, therefore high-speed printing similar to a laser printer is possible. Moreover, since a carriage for mounting the printing head and a drive system for moving the carriage are not necessary, a chassis of the printer can be reduced in size and weight, and furthermore quietness is remarkably improved. This type of inkjet printer is generally called a "line head printer".

Since a printing head indispensable for such an inkjet printer is formed by arranging small nozzles 10 to 70 μm in diameter in one line with a constant interval or arranging the nozzles in several lines in a printing direction, the discharge directions of ink from some nozzles may be deflected due to manufacturing errors, or a position of the nozzle may be disposed at a position shifted from an ideal position. Consequently a so-called "flying bend phenomenon" such as a phenomenon that the landing positions of dots formed by the nozzle may be shifted from target points may occur.

As a result, a printing defect, known as a so-called "banding (line) phenomenon" may occur, which sometimes significantly reduces printing quality. That is, once the "flying bend phenomenon" occurs, a "white line (in the case of a white printing paper)" appears at a portion where a distance between dots discharged from adjacent nozzles is large, and a "dark line" appears at a portion where the distance between dots discharged from adjacent nozzles is short.

In particular, such a banding phenomenon tends to occur more significantly in the "line head printer" where the printing head or the printing medium is fixed (one pass printing) as compared with the case of the "multi-pass printer" (serial printer) (in the multi-pass printer, there is a technique of making the banding relatively inconspicuous by reciprocating the printing head many times).

Therefore, to prevent a kind of, printing defect due to such a "banding phenomenon", research and development in hardware, such as improvement in manufacturing or improvement in the design of the printing head are earnestly pursued, however, it is difficult in view of manufacturing cost or technology to provide a printing head in which the "banding phenomenon" does not occur 100% of the time.

Thus, in addition to the improvement in the hardware, technology for reducing such a "banding phenomenon" using a so-called software method such as the following printing controls is now combined.

To solve the problem, a technique is proposed, in which dark and light, that is, two types of ink including dark ink having high dye concentration and light ink having a lower dye concentration than that of the dark ink and high permeability, are provided, and dots are formed using the light ink in the whole halftone (for example, refer to JP-A-11-48462). According to the technique, the high permeability of the light ink causes bleeding and consequently a dot larger in size than a dot to be essentially formed is formed. Therefore, even if the landing position of the dot is shifted particularly due to the flying bend, a blank space caused by shifting of the position can be compensated, and consequently the occurrence of the white line can be suppressed (for example, refer to JP-A-11-48462 (FIG. 1)).

However, there has been a problem in the related art that since the light ink is used in the full halftone range, and thus comparatively large dots are formed, respective dots become easily visible, and consequently a granular feeling of a printed image is increased.

Furthermore, there is a problem that since the high permeability of the light ink is used for suppressing the occurrence of the white line, ink having low permeability such as pigment ink can not be used.

SUMMARY

An advantage of some aspects of the invention is to provide an image processor, an image processing method, a printer, a printing method, a program, and a recording medium, which can suppress an increase in the granular feeling of a printed image as a whole, and in addition, relieve the restriction of the ink type and prevent a printing defect due to the banding phenomenon such as a white line or a dark line in the case of printing using a bad nozzle irrespective of the level of permeability.

First Mode

An image processor according to a first mode is for a printer for forming an image on a medium by discharging N types (N is a natural number of 2 or more) of ink having different density for at least one color system from respective nozzles, and includes a printing image data generator for generating printing image data based on image data, a printing image output unit for outputting the printing image data, a nozzle information acquisition unit for acquiring information on the nozzles, and a substitute unit that, when a bad nozzle is found in the nozzle information, substitute a nozzle, which discharges another type of ink among the N types of ink, for the bad nozzle are provided.

According to the image processor, since dots are formed by the nozzle that discharges the other type of ink in place of the nozzle in which the flying bend occurs, the appearance of the white line or dark line (so-called banding) due to the flying bend in a nozzle is suppressed. Moreover, since permeability of the light ink need not be used for suppressing the appearance of the white line or dark line in this way, ink having low permeability such as pigment ink can be used for the ink, and consequently the restriction on usable types of ink can be relieved.

Here, the term "dot" in the mode is a base unit for expressing a letter or a figure on prints, which means a single area when ink discharged from one or multiple nozzle/nozzles lands on a medium. Moreover, the "dot" naturally has a certain size (area) rather than an area of "zero", and plural types of dots exist for each size. Moreover, a shape of the dot is not necessarily limited to round, and may include shapes other than round such as an ellipse. In this case, a diameter is not uniform, therefore a dot size of the dot is determined according to an area occupied by the dot, or based on the average diameter of the dot (this is same in the following description on modes on a "printer", a "printing program", a "printing method", an "image processor", an "image processing program", an "image processing method", and a "recording medium having the program recorded therein", and description in a section of DESCRIPTION OF EXEMPLARY EMBODIMENTS).

When the "dot size" is defined more exactly, an equivalent round dot having an area equal to an area of a dot formed by discharging a certain amount of ink is assumed, and the diameter of the equivalent dot is defined as the dot size. Moreover, since an absorption factor of ink is generally changed depending on a printing medium, it is natural that the dot size of a dot to be formed is variously changed upon change of the printing medium even if the amount of ink is constant. Moreover, the "dot" is not necessarily limited to one formed by one ink droplet in one discharge, and includes a dot formed by combining ink droplets formed by at least two discharges, such as a case of a maximum dot.

The nozzle in which the flying bend occurs means a nozzle in which the discharge direction of the ink is deflected, consequently the landing position of the dot is shifted. The image processor can be implemented, for example, by using a computer that is communicatively connected to a printer and outputs printing image data to the printer; or also implemented by incorporating the computer that realizes the image processor into the printer.

Second Mode

According to a second mode, which is according to the first mode, the image processor includes a plane generator for generating a plane that determines a density value of each pixel for each type of ink, wherein regarding a first plane corresponding to a type of ink in the bad nozzle, the plane generator allocates a density value of a pixel, in which the dots are formed by the bad nozzle, to a pixel corresponding to a second plane of some other type of ink.

According to the configuration, since the plane generator for generating the plane that determines the density value of each pixel for each type of ink is included, the appearance of the white line due to the flying bend can be suppressed by allocating the density value of the pixel, in which the dots are formed by the bad nozzle, to the pixel corresponding to the plane of the other type of ink, for example, by distributing cyan to light cyan and the like.

The plane means image data of respective colors after color conversion. For example, when RGB image data is subjected to color conversion into CMKY image data, respective image data of C, M, Y and K are called plane.

Third Mode

According to a third mode, which is according to the image processor according to the second mode, the image processor includes an ink-tone-range acquisition unit for acquiring a tone range that can be expressed by at least the ink corresponding to the plane allocated with the density value by the plane generator among the N types of ink.

According to the configuration, the tone range that can be expressed by the ink corresponding to the plane allocated with the density value by the plane generator is acquired, thereby when a desired tone is realized, whether the ink can be reproduced can be decided.

Fourth Mode

According to a fourth mode, which is according to the image processor according to the third mode, when the density value is allocated to the other type of plane, the plane generator acquires a tone range of the ink corresponding to the plane to be allocated with the value; and when the density value exceeds a maximum density value corresponding to the tone range, it allocates a density value equivalent to the relevant, exceeded density value to the other type of plane.

According to the configuration, when the density value exceeds the maximum density value corresponding to the tone range, the density value equivalent to the relevant, exceeded density value to the other type of plane, therefore the appearance of the white line is suppressed, and a tone that can not be reproduced by substitutive ink can be reproduced.

Fifth Mode

According to an image processing method according to a fifth mode, the image processing method is a method for a printer that forms an image on a medium by discharging N types (N is a natural number of 2 or more) of ink having a different density for at least one color system from respective nozzles, which includes generating printing image data based on image data, outputting the printing image data, acquiring information on the nozzle, and when a bad nozzle is found in the nozzle information, substituting the nozzle, which discharges some other type of ink among the N types of ink, for the bad nozzle.

According to the configuration, the same effect as in the first mode is obtained.

Sixth Mode

According to a sixth mode, which is according to the image processing method according to the fifth mode, the image processing method includes generating a plane for determining a density value of each pixel for each type of ink based on the image data, wherein regarding a first plane corresponding to a type of ink in the bad nozzle, a density value of a pixel, in which the dots are formed by the bad nozzle, is allocated to a pixel corresponding to a second plane of some other type of ink.

According to the configuration, the same effect as in the second mode is obtained.

Seventh Mode

According to a seventh mode, which is according to the image processing method according to the sixth mode, the image processing method includes acquiring a tone range that can be expressed by at least the ink corresponding to the described plane allocated with the density value among the N types of ink.

According to the configuration, the same effect as in the third mode is obtained.

Eighth Mode

According to an eighth mode, which is according to the image processing method according to the seventh mode, when the density value is allocated to the other plane, a tone range of the ink corresponding to the plane to be allocated is acquired, and when the density value exceeds a maximum density value corresponding to the tone range, a density value equivalent to the relevant, exceeded density value is allocated to the other type of plane.

According to the configuration, the same effect as in the fourth mode is obtained.

Ninth Mode

According to a printer according to a ninth mode, the printer includes a printing image data generator for generating printing image data based on image data, a printing unit for forming an image on a medium by discharging N types (N is a natural number of 2 or more) of ink having a different density for at least one color system from respective nozzles based on the printing image data, a nozzle information acquisition unit for acquiring information on the nozzles, and a substitute unit that, when a bad nozzle is found in the nozzle information, substitutes a nozzle, which discharges some other type of ink among the N types of ink, for the bad nozzle.

According to the configuration, the same effect as in the first mode is obtained.

Tenth Mode

According to a tenth mode, which is according to the printer according to the ninth mode, the printer includes a plane generator for generating a plane for determining a density value of each pixel for each type of ink, wherein, regarding a first plane corresponding to a type of ink in the bad nozzle, the plane generator allocates a density value of a pixel, in which the dots are formed by the bad nozzle, to a pixel corresponding to a second plane of some other type of ink.

According to the configuration, the same effect as in the second mode is obtained.

Eleventh Mode

According to an eleventh mode, which is according to the printer according to the tenth mode, the printer includes an ink-tone-range acquisition unit for acquiring a tone range that can be expressed by at least the ink corresponding to the plane allocated with the density value by the plane generator among the N types of ink.

According to the configuration, the same effect as in the third mode is obtained.

Twelfth Mode

According to a twelfth mode, which is according to the printer according to the eleventh mode, when the density value is allocated to the other type of plane, the plane generator acquires the tone range of the ink corresponding to the plane to be allocated with the value, and when the density value exceeds a maximum density value corresponding to the tone range, it allocates a density value equivalent to the relevant, exceeded density value to the other type of plane.

According to the configuration, the same effect as in the fourth mode is obtained.

Thirteenth Mode

According to a printing method according to a thirteenth mode, the printing method includes generating printing image data based on image data, forming an image on a medium by discharging N types (N is a natural number of 2 or more) of ink having different density for at least one color system from respective nozzles based on the printing image data, acquiring information on the nozzles, and when a bad nozzle is found in the nozzle information, substituting the nozzle, which discharges another type of ink among the N types of ink, for the bad nozzle.

According to the configuration, the same effect as in the first mode is obtained.

Fourteenth Mode

According to a fourteenth mode, which is according to the printing method according to the thirteenth mode, the printing method includes generating a plane for determining a density value of each pixel for each type of ink based on the image data, wherein regarding a first plane corresponding to a type of the ink in the bad nozzle, a density value of a pixel, in which the dots are formed by the bad nozzle, is allocated to a pixel corresponding to a second plane of some other type of ink.

According to the configuration, the same effect as in the second mode is obtained.

Fifteenth Mode

According to a fifteenth mode, which is according to the printing method according to the fourteenth mode, the printing method includes acquiring a tone range that can be expressed by at least the ink corresponding to the described plane allocated with the density value among the N types of ink.

According to the configuration, the same effect as in the third mode is obtained.

Sixteenth Mode

According to a sixteenth mode, which is according to the printing method according to the fifteenth mode, when the density value is allocated to the other plane, the tone range of the ink corresponding to the plane to be allocated with the value is acquired, and when the density value exceeds a maximum density value corresponding to the tone range, a density value equivalent to the relevant, exceeded density value is allocated to the other type of plane.

According to the configuration, the same effect as in the fourth mode is obtained.

Seventeenth Mode

According to an image processing program according to a seventeenth mode, the program allows a computer for a printer that forms an image on a medium by discharging N types (N is a natural number of 2 or more) of ink having different density for at least one color system from respective nozzles to execute processing implemented by generating printing image data based on image data, outputting the printing image data, acquiring information on the nozzles, and when a bad nozzle is found in the nozzle information, substituting a nozzle, which discharges some other type of ink among the N types of ink, for the bad nozzle.

According to the configuration, the same effect as in the first mode is obtained.

Eighteenth Mode

According to an eighteenth mode, which is according to the image processing program according to the seventeenth mode, the image processing program includes generating a plane for determining a density value of each pixel for each type of ink based on the image data, wherein regarding a first plane corresponding to a type of ink in the bad nozzle, a density value of a pixel, in which the dots are formed by the bad nozzle, is allocated to a pixel corresponding to a second plane of some other type of ink.

According to the configuration, the same effect as in the second mode is obtained.

Nineteenth Mode

According to a nineteenth mode, which is according to the image processing program according to the eighteenth mode, the program includes acquiring a tone range that can be expressed by at least the ink corresponding to the described plane allocated with the density value among the N types of ink.

According to the configuration, the same effect as in the third mode is obtained.

Twentieth Mode

According to a twenty mode, which is according to the image processing program according to the nineteenth mode, when the density value is allocated to the other plane, the tone range of the ink corresponding to the plane to be allocated with the value is acquired, and when the density value exceeds a maximum density value corresponding to the tone range, a density value equivalent to the relevant, exceeded density value is allocated to the other type of plane.

According to the configuration, the same effect as in the fourth mode is obtained.

Twenty-First Mode

According to a recording medium according to a twenty-first mode, the recording medium stores a program for allowing a computer for a printer that forms an image on a medium by discharging N types (N is a natural number of 2 or more) of ink having different density for at least one color system from respective nozzles to execute processing implemented by generating printing image data based on image data, outputting the printing image data, acquiring information on the nozzles, and when a bad nozzle is found in the nozzle information, substituting a nozzle, which discharges some other type of ink among the N types of ink, for the bad nozzle.

According to the configuration, the same effect as in the first mode is obtained.

Twenty-Second Mode

According to a twenty-second mode, which is according to the recording medium according to the twenty-first mode, the recording medium includes generating a plane for determining a density value of each pixel for each type of ink based on the image data, wherein regarding a first plane corresponding to a type of ink in the bad nozzle, a density value of a pixel, in which the dots are formed by the bad nozzle, is allocated to a pixel corresponding to a second plane of some other type of ink.

According to the configuration, the same effect as in the second mode is obtained.

Twenty-Third Mode

According to a twenty-third mode, which is according to the recording medium according to the twenty-second mode 22, when the density value is allocated to the other plane, the tone range of the ink corresponding to the plane to be allocated with the value is acquired, and when the density value exceeds a maximum density value corresponding to the tone range, a density value equivalent to the relevant, exceeded density value is allocated to the other type of plane.

According to the configuration, the same effect as in the fourth mode is obtained.

Twenty-Fourth Mode

According to a further mode, which is according to the recording medium according to the twenty-third mode, the recording medium includes acquiring a tone range that can be expressed by at least the ink corresponding to the described plane allocated with the density value among the N types of ink.

According to the configuration, the same effect as in the third mode is obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment according to the invention will be described with reference to drawings. In the following description, a nozzle in which flying bend occurs is described as an example of a bad nozzle.

Figure 1:
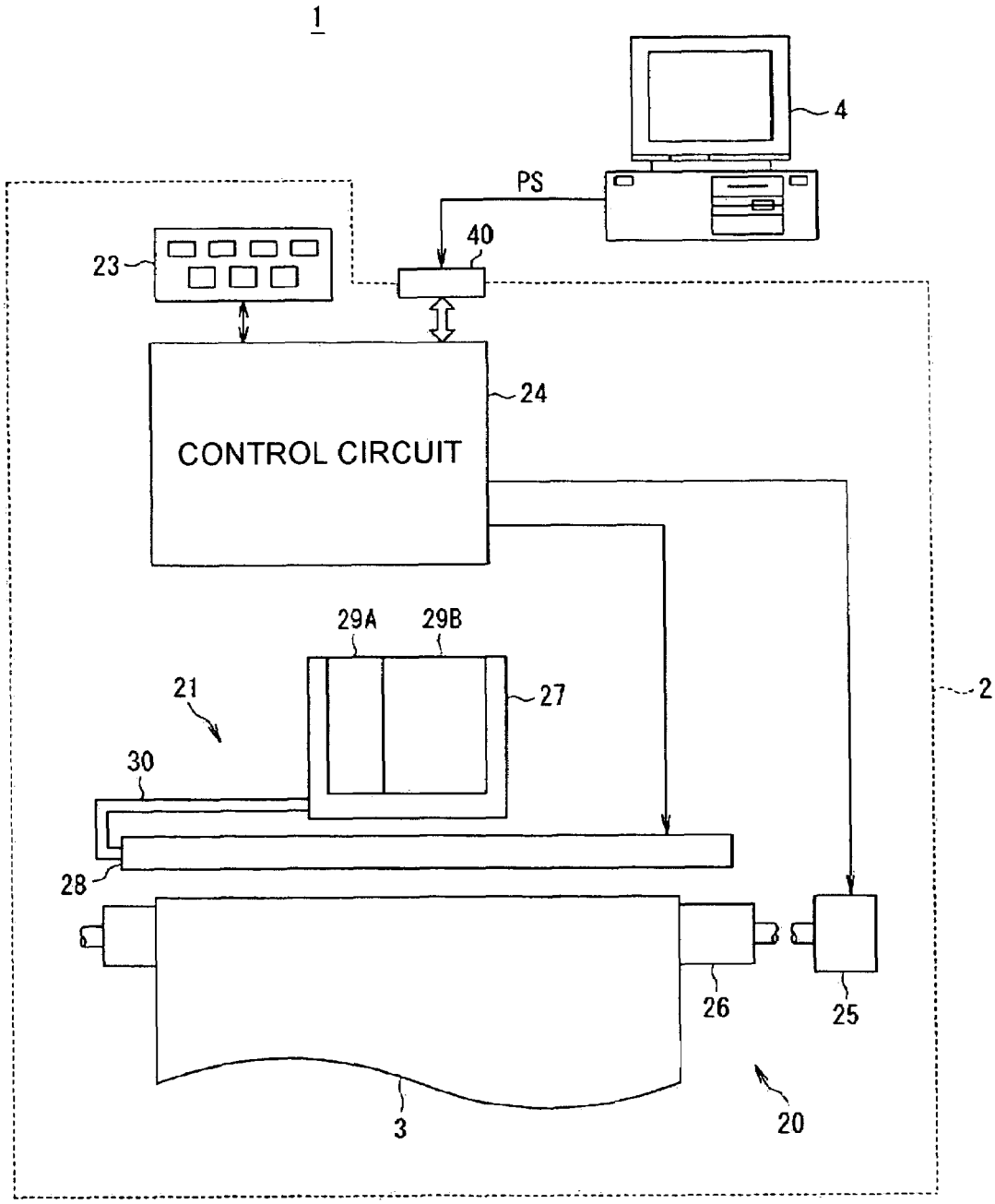
FIG. 1 is a drawing showing a computer system for printing of a first embodiment of the invention.

FIG. 1 is a schematic block diagram of a computer system 1 having a color inkjet printer (hereinafter, simply called "printer") 2 as an aspect of a printer (image processor).

As shown in this figure, the printer 2 has a paper carrying mechanism 20 for carrying a recording paper 3, a head unit 21 for discharging ink toward the recording paper 3 to form dots, a head drive circuit 22 for controlling discharge of ink and dot formation by the head unit 21 (refer to FIG. 2), an operation panel 23, and a control circuit 24 that controls exchange of signal among the paper carrying mechanism 20, head unit 21 and operation panel 23.

The paper carrying mechanism 20 has a paper feed motor 25 that is actuated and controlled by the control circuit 24, and a paper feed roller 26 that is rotationally driven by rotation of the paper feed motor 25, and the recording paper 3 is carried by rotation of the paper feed roller 26.

The head unit 21 has an ink tank 27 and a line head 28.

In the ink tank 27, a cartridge 29A that contains ink of black (K), and a cartridge 29B that contains color ink are provided in a freely mountable and removable manner. Here, the printer 2 according to the embodiment is a multivalued printer that can form dots having small, medium and large diameters using dark and light color ink as described later, and assumed to use ink of five colors in total as the color ink: cyan (C), magenta (M), and yellow (Y), which are colors of dark ink having high dye concentration, in addition, light cyan (C1) and light magenta (M1), which are colors of light ink having low dye concentration.

An ink supply channel 30 is led out from the ink tank 27 and connected to the line head 28, and ink is supplied from the ink tank 27 to the line head 28 via the ink supply channel 30.

Figure 2:
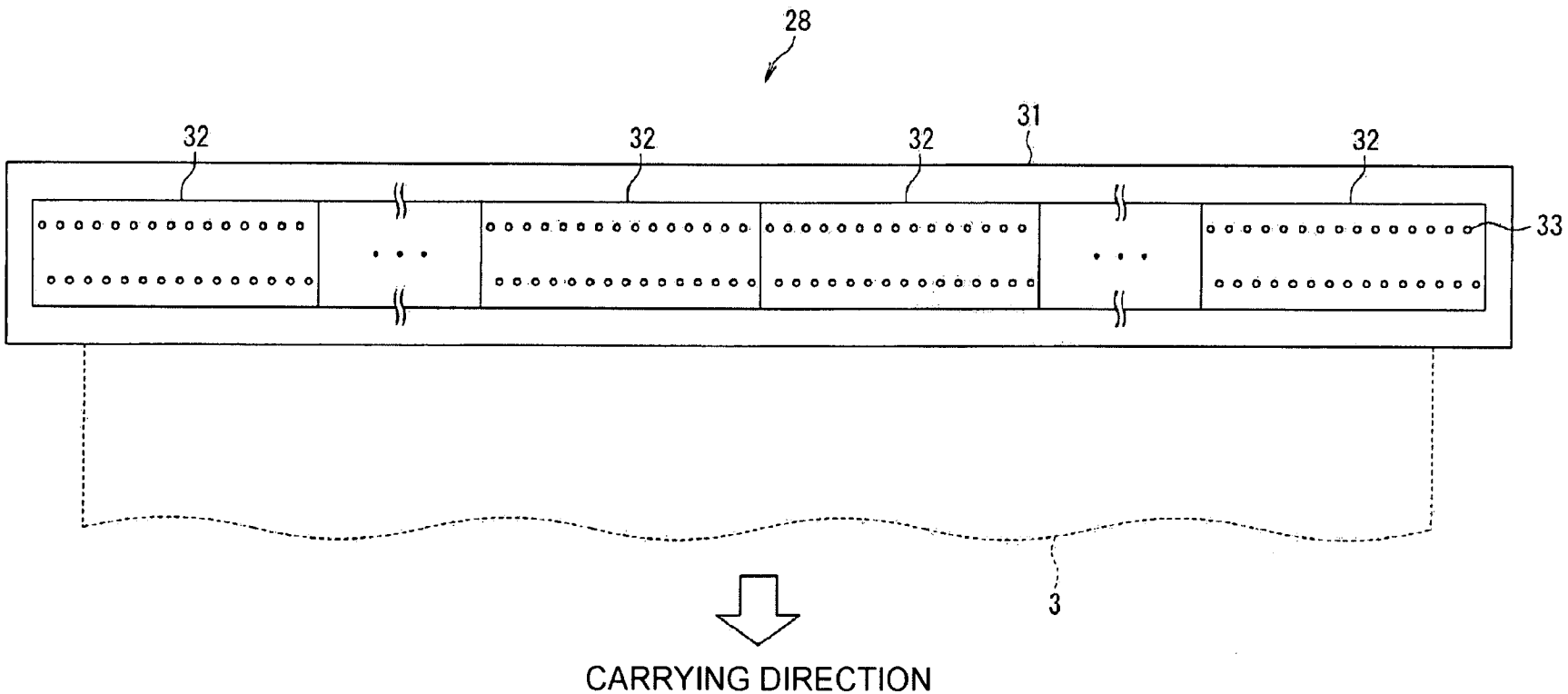
FIG. 2 is a drawing showing a configuration of a head unit.

As shown in FIG. 2, the line head 28 has a supporting frame 31 and a plurality of nozzle heads 32 which are fixed in a line on the supporting frame 31. A plurality of nozzles (discharge ports) 33 for discharging ink are formed in each of the nozzle heads 32. The nozzles 33 are provided for each of the black (K), cyan (C), magenta (M), yellow (Y), light cyan (C1), and light magenta (M1). That is, dark ink nozzles 33 for discharging dark ink are provided for each of the black (K), cyan (C), magenta (M), and yellow (Y), and light ink nozzles 33 for discharging light ink are provided for each of the light cyan (C1) and light magenta (M1).

A piezoelectric element (not shown) that is one of electrostriction elements and excellent in response is disposed in each of the nozzles 33. The piezoelectric elements are disposed close against members that forms ink channels for guiding ink into the nozzles 33. The piezoelectric element has a crystal structure that is distorted upon application of voltage, and performs electric-to-machine energy conversion at extremely high speed. Upon application of voltage in a predetermined time range between electrodes provided at two ends of the piezoelectric element, the piezoelectric element is stretched only for a period during the voltage application, which transforms a sidewall of the ink channel. As a result, volume of the ink channel is contracted in correspondence with the stretch of the piezoelectric element, and ink corresponding to a level of the contraction is discharged as an ink droplet from a tip of the nozzle 33 at high speed. Then, the ink droplet permeates the recording paper 3 that is fed along the paper feed roller 26, thereby dots are formed for image printing.

A plurality of such nozzle heads 32 are arranged on the supporting frame 31 in a lateral direction relative to the recording paper 3, thereby the nozzles 33 are arranged over the full width of the recording paper 3, and consequently image formation is carried out at one time over the full width of the recording paper 3. An image is formed in a lateral direction relative to the recording paper 3 by the head unit 21, and the recording paper 3 is concurrently carried in a carrying direction, thereby the image formation in the carrying direction relative to the recording paper 3 is performed.

While each of the nozzles 33 is formed with an approximately fixed diameter here, the printer 2 can form three types of dots of small (S), medium (M), and large (L) having different diameters using such a nozzle 33. In detail, it is generally known that dot size can be controlled by controlling a voltage waveform applied to the piezoelectric element (in particular, a voltage waveform when negative voltage is applied); and in the printer 2, respective voltage waveforms for forming the dots of small (S), medium (M), and large (L) are previously prepared based on a relation between a voltage waveform and dot size, and the three types of dots having, different diameters can be formed through appropriate selection from the voltage waveforms. In addition, the three types of dots are formed in an appropriate density to express the image tone (density). Specifically, when a high tone (high density) is expressed, large (L) dots are densely formed, and as the tone (density) is lowered, dot size is decreased, or the density of the dot is lowered.

Moreover, in the embodiment, it is designed that when the large (L) dots are formed using light ink, a distance between adjacent dots is sufficiently small; therefore when printing is carried out using the large (L) dots of the light ink, a space between the dots is filled up. A specific description on printing using the dark ink and the light ink is made in detail later.

As shown in FIG. 1, the control circuit 24 of the printer 2 is connected to a computer 4 via the connector 40. The computer 4, which has driver software for the printer 2 loaded therein, receives an instruction from a user through operation of a keyboard, mouse and the like as an input device, and is configured as a user interface that presents various types of information in the printer 2 by displaying it on a screen of a display device.

Figure 3:
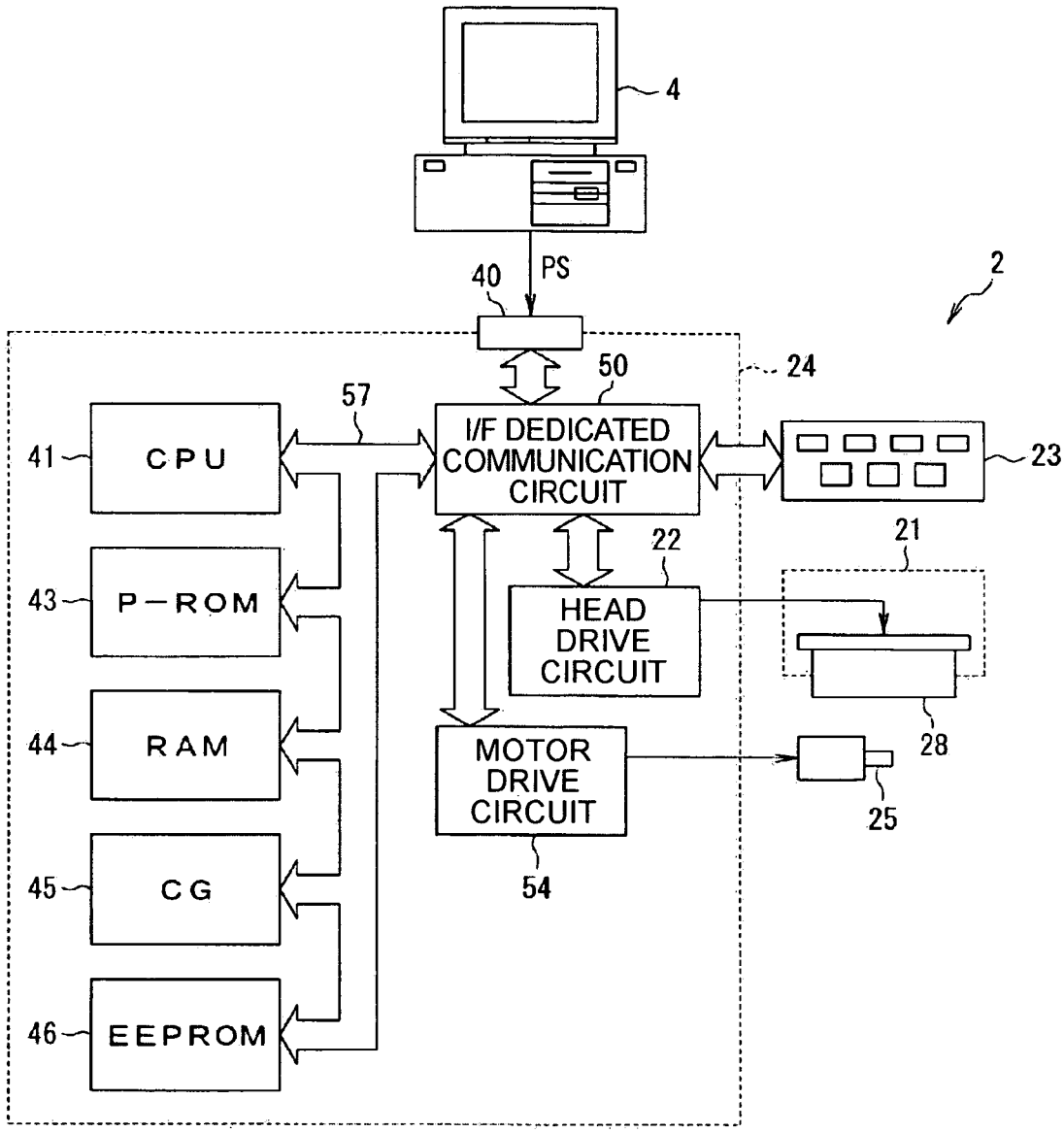
FIG. 3 is a drawing showing a functional configuration of a control circuit of a printer.

FIG. 3 is a block diagram showing a configuration example of a main part of the printer mainly including the control circuit 24. As shown in the figure, the control circuit 24 is configured as an arithmetic logic computing circuit having CPU (Central Processing Unit) 41, a programmable ROM (P-ROM (Read Only Memory)) 43, RAM (Random Access Memory) 44, a character generator (CG (Character Generator)) 45, and EEPROM (Electronically Erasable and Programmable ROM) 46.

The control circuit 24 further has an I/F dedicated communication circuit 50 that is an interface I/F (Interface) with an external motor and the like, a head drive circuit 22 that is connected to the I/F dedicated communication circuit 50 and drives the head unit 21 to discharge ink, and a motor drive circuit 54 that drives the paper feed motor 25.

The I/F dedicated communication circuit 50 incorporates a parallel interface circuit and can receive a printing signal PS supplied from the computer 4 via a connector 40.

Next, a configuration of the computer 4 is described with reference to FIG. 4.

Figure 4:
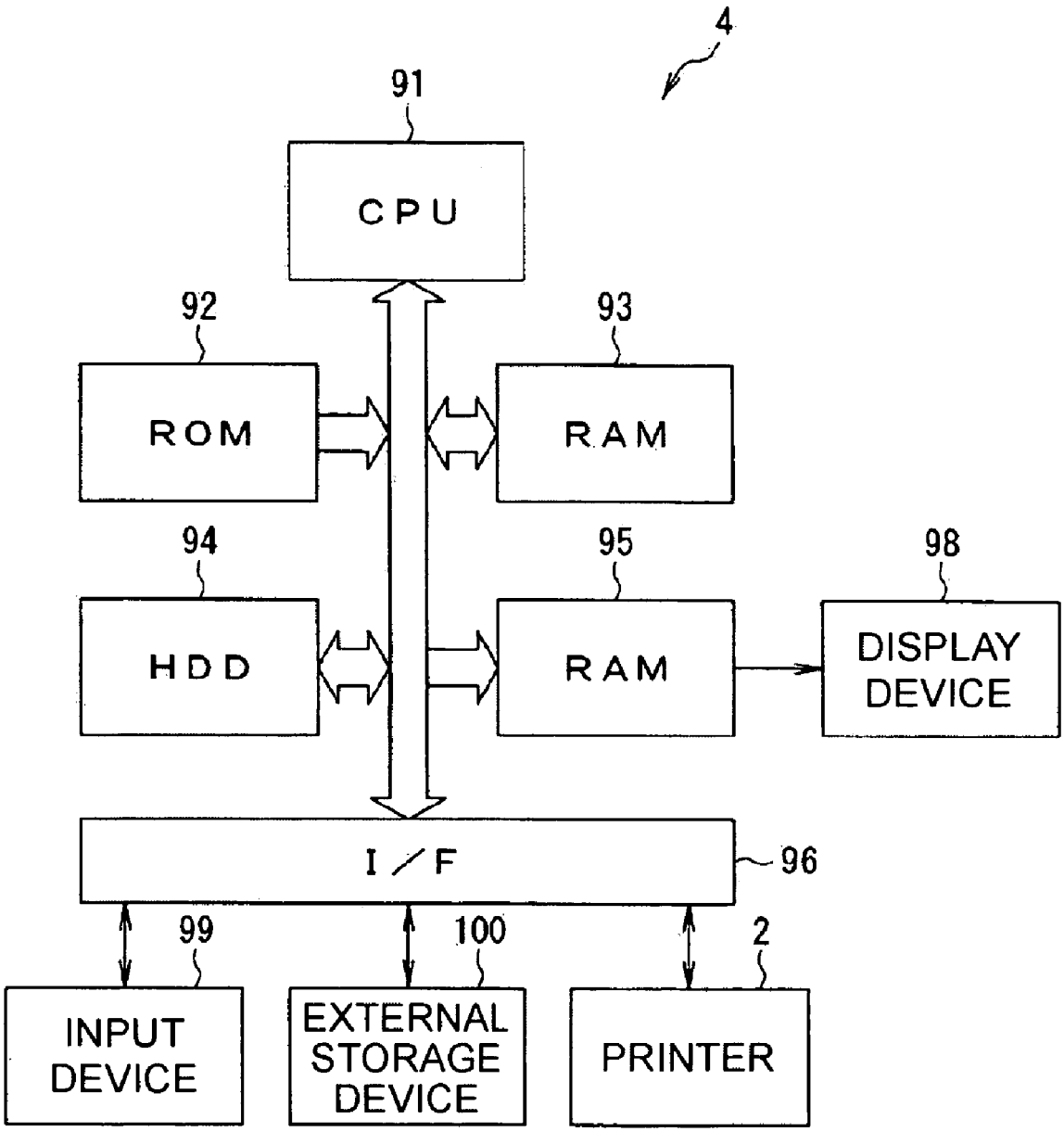
FIG. 4 is a drawing showing a functional configuration of a computer.

As shown in FIG. 4, the computer 4 has CPU 91, ROM 92, RAM 93, HDD (Hard Disk Drive) 94, a video circuit 95, I/F 96, a bus 97, a display device 98, an input device 99 and an external storage device 100.

The CPU 91 is a controller that executes various types of computation according to programs stored in the ROM 92 or the HDD 94, and controls various parts of the devices.

The ROM 92 is a memory that stores a basic program to be executed by the CPU 91 and data. The RAM 93 is a memory that temporarily stores a program in execution by the CPU 91, or data in computation.

The HDD 94 reads data or a program recorded in a hard disk as a recording medium in response to request from the CPU 91, and records data created as a result of computation of the CPU 91 into the hard disk.

The video circuit 95 is a circuit that executes drawing processing in response to a drawing instruction supplied from the CPU 91, and converts obtained image data into a video signal and outputs it to the display device 98.

The I/F 96 is a circuit that appropriately changes an expression format of a signal outputted from the input device 99 and the external storage device 100, and outputs the printing signal PS to the printer 2.

The bus 97 is a signal line that connects the CPU 91, ROM 92, RAM 93, HDD 94, video circuit 95 and I/F 96 to one another, and enables transmission/reception of data among them.

The display device 98 is a device that is configured by, for example, an LCD (Liquid Crystal Display) monitor or a CRT (Cathode Ray Tube) monitor for displaying an image in accordance with a video signal outputted from the video circuit 95.

The input device 99 is configured by, for example, a keyboard or a mouse for generating a signal in response to operation of a user and supplying it to the I/F 96.

The external storage device 100 is a device that is configured by, for example, a CD-ROM (Compact Disk-ROM) drive unit, an MO (Magneto-optical) drive unit, or an FDD (Flexible Disk Drive) unit for reading data or a program recorded in the CD-ROM disk, MO disk, or FD and supplying the data or program to the CPU 91. In the case of the MO drive unit and the FDD unit, the device records data supplied from the CPU 91 into a MO disk or FD.

As above, the computer 4 has the printer driver software for the printer 2 previously installed therein, and the printer driver loaded therein. An image processing program used for printing is incorporated in the printer driver software, and the computer 4 acts as an image processor for the printer 2 by executing the image processing program.

Figure 5:
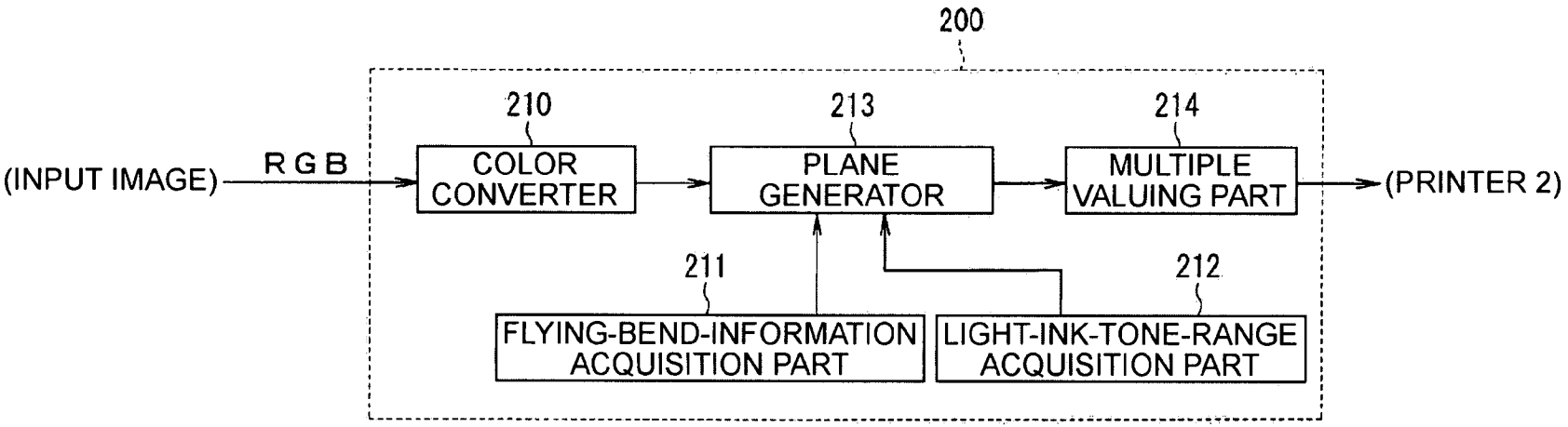
FIG. 5 is a block diagram showing a functional configuration of an image processor.

FIG. 5 is a diagram showing a functional block of an image processor 200 realized by the printer driver software for the printer 2 installed in the computer 4. As shown in the figure, the image processor 200 has a color converter 210, flying-bend-information acquisition part 211, light-ink-tone-range acquisition part 212, plane generator 213, and multiple valuing part 214.

The color converter 210 receives image data expressed in the RGB (Red, Green and Blue) color system as input image data to be a printing object, and converts the data into tone data that defines a tone level for each pixel of each of colors of the CMYK (Cyan, Magenta, Yellow and Black) color system. The tone data of each color is sent to the plane generator 213.

The flying-bend-information acquisition part 211 acquires identification information of a nozzle 33 in which a bend of a discharge direction of ink (flying bend) occurs, and thus a landing position of the ink is shifted among nozzles 33 of the line head 28, and outputs it to the plane generator 213. Specifically, a flying bend characteristic of ink is different for each machine of the printer 2. For example, a predetermined test pattern is printed by the printer 2, then a printed test pattern is read by a scanner and compared to an original test pattern, thereby the flying-bend characteristic for each machine of the printer 2 is obtained. In factory shipment of the printer 2, the flying bend characteristic is obtained in the above manner and stored in the EEPROM 46 of the printer 2, and then the printer is shipped with the characteristic having been stored. Therefore, the flying-bend-information acquisition part 211 acquires the flying bend characteristic from the printer 2, and then identifies identification information of the nozzle 33 in which flying bend of ink occurs, and then sends a result of identification to the plane generator 213. In a broad sense, the flying-bend-information acquisition part 211 is referred to as a nozzle information acquisition part in the sense of acquiring information on nozzles.

Figure 6:
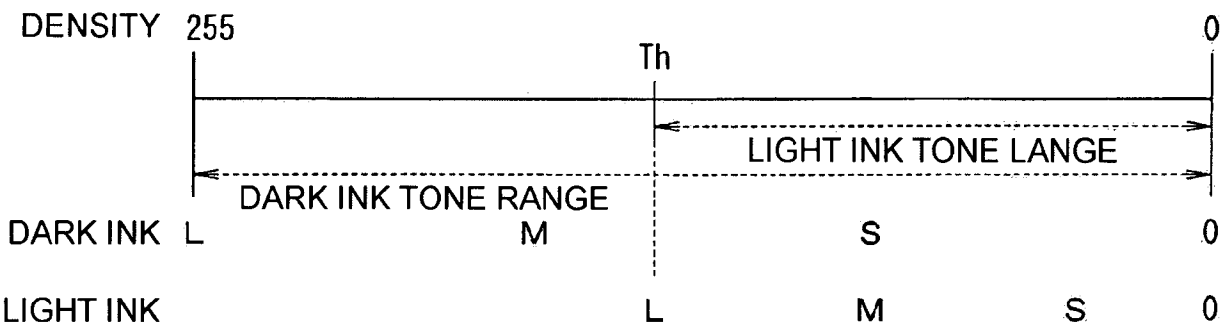
FIG. 6 is a drawing for illustrating a tone range of dark ink and light ink.

The light-ink-tone-range acquisition part 212 acquires a tone range that can be drawn by each light ink of light cyan (C1) and light magenta (M1), and outputs it to the plane generator 213. In detailed description, as shown in FIG. 6, in the case of the dark ink, multiple tones of 0 to the highest tone (here, 255) can be expressed by using the large (L), medium (M) and small (S), three different dots, however, in the case of the light ink, an expressible tone range is narrow compared with the dark ink because of low density compared with the dark ink, therefore the highest tone (density) can not be expressed even if the large (L) size dots are used. Thus, an expressible highest tone Th that can be expressed by the light ink is previously obtained for each of colors of light cyan (C1) and light magenta (M1), and stored in the EEPROM 46 of the printer 2 as the expressible highest tone Th. The light-ink-tone-range acquisition part 212 acquires the expressible highest tone Th of each of the colors of light cyan (C1) and light magenta (M1) from the printer 2 and outputs it to the plane generator 213.

Here, as a method for obtaining the expressible highest tone Th of the light ink, the following method can be considered: a test pattern for testing the tone range of the light ink is printed by the printer 2, a printed test pattern is read by a scanner and formed into an image, and the expressible highest tone Th of the light ink is obtained from the image.

Rather than the configuration in which the expressible highest tone Th obtained in this way is stored in the EEPROM 46 of the printer 2, a configuration in which the expressible highest tone Th is incorporated in a image processing program as data, and the data is referred as needed is also acceptable. In the configuration, the expressible highest tone Th is stored in the HDD 94 of the computer 4 together with the image processing program.

The plane generator 213 performs plane generation processing on the tone data of respective color systems of cyan (C) and magenta (M) which allows use of dark and light, two types of ink as objects, among the tone data of respective colors of the CMYK color system received from the color converter 210. The plane generation processing is processing for generating two planes including a dark-ink nozzle plane for printing by the dark ink nozzle 33 that discharges the dark ink and a light-ink nozzle plane for printing by the light ink nozzle 33 that discharges the light ink based on the tone data of respective color systems of cyan (C) and magenta (M)

In the embodiment, printing is normally performed using the dark ink, and when the dark ink nozzle 33 in which the flying bend occurs is present, a pixel in which dots are to be formed by the dark ink nozzle 33 is formed by forming the dots using the light ink nozzle 33 in place of the dark ink nozzle 33. That is, a substitute part for substituting for the nozzle in which the flying bend occurs to a nozzle that discharges some other type of ink is provided.

Figure 7A:
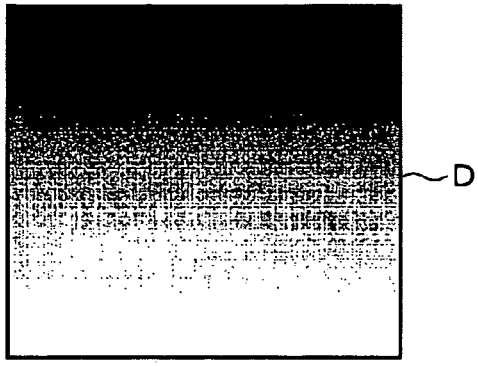
FIGS. 7A to 7C are drawings for illustrating plane generation processing.
Figure 7B:
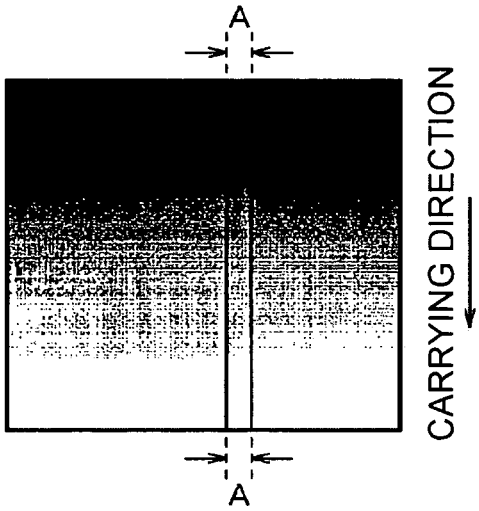
Figure 7C:
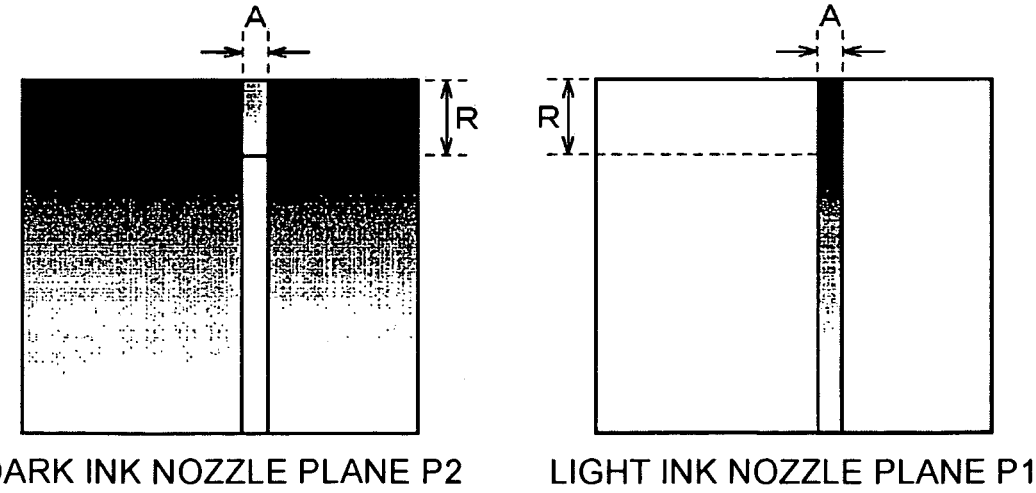

Therefore, for example, when a plane is generated on monochrome tone data D shown in FIG. 7A, in the plane generation processing, as shown in FIG. 7B, first a pixel area A to be printed by the dark ink nozzle 33 in which the flying bend occurs is specified. Then, as shown in FIG. 7C, a light ink nozzle plane P1 to which tones of respective pixels in the pixel area A are allocated is generated in order to print the pixel area A by the light ink nozzle 33.

At that time, as described above, since the highest tone (here 255) can not be expressed only by the light ink, regarding an insufficient tone in each pixel in the pixel area A, dark ink is discharged from the dark ink nozzle 33 such that the insufficient tone is compensated and thus dots are formed. That is, as shown in FIG. 7C, in the light ink nozzle plane P1, the expressible highest tone Th is allocated as a tone to all pixels in a pixel group where a tone of pixels in the pixel area A exceeds the expressible highest tone Th of the light ink; and in the dark ink nozzle plane P2, a tone that is enough to compensate the insufficient tone is allocated to the pixel group R. Specifically, when the tone of the pixels in the pixel group R is Q (>Th), a tone of Q-Th is allocated to the pixels in the dark ink nozzle plane P2.

The plane generator 213 generates the dark and light, nozzle planes P1, P2 for each of colors of cyan (C) and magenta (M) in the above manner, then generates tone data of the dark and light, nozzle planes P1, P2, and tone data of yellow (Y) and black (K).

The multiple valuing part 214 receives the tone data of the dark and light, nozzle planes P1, P2 for each of colors of cyan (C) and magenta (M), and the tone data of yellow (Y) and black (K) from the plane generator 213, and converts them into signals that can be processed by the printer 2 (here, multivalued signals on respective colors of C, M, Y, K, C1 and M1). Then, the converted signals are outputted from the I/F 96 (output unit) to the printer 2 as the printing signals PS. That is, the multiple valuing part 214 is a printing image data generator that generates printing image data, and the printing image data are outputted to the printer 2 via an output part.

Next, an operation of the embodiment is described.

When a request of starting an application program is made, for example, through operation of the input device 99 of the computer 4 by a user, the CPU 91 reads a corresponding application program from the HDD 94 and executes the program. As a result, the application program is started, and the image data can be generated or edited. After an image is drawn or edited by using such an application program, when a request of printing a generated image is made via the input device 99, the CPU 91 supplies the generated image data to the printer driver software. At that time, the image data are data expressed in the RGB color system. Along with image data supply to the printer driver software, the computer 4 executes the image processing program to act as the image processor 200.

Figure 8:
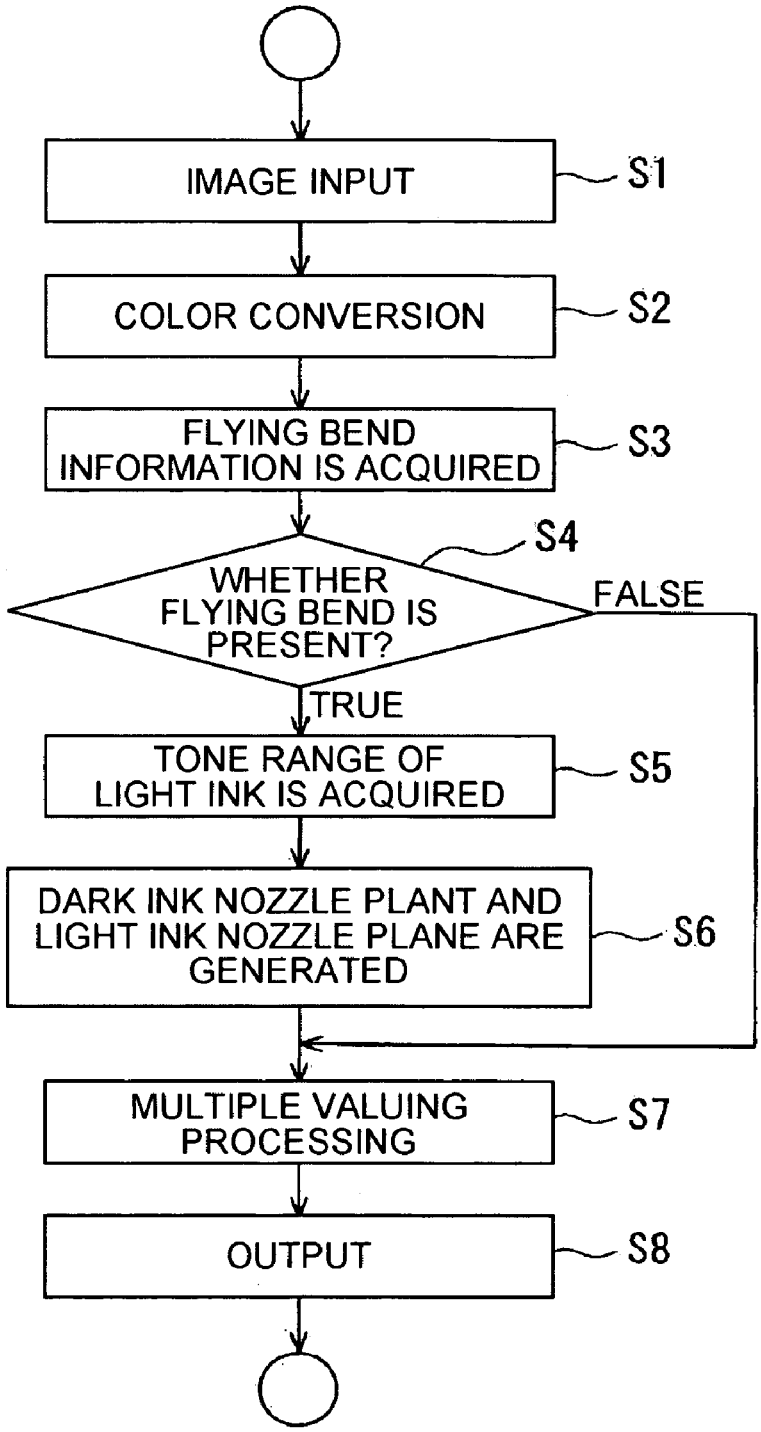
FIG. 8 is a flowchart showing image processing during printing operation.

In the image processor 200, as shown in FIG. 8, when the image data expressed in the RGB color system using the application program is inputted (step S1), the color converter 210 converts inputted image data into tone data for each of the color systems in the CMYK color system, and outputs the tone data to the plane generator 213 (step S2).

Next, the flying-bend-information acquisition part 211 acquires the identification information of the dark ink nozzle 33 in which flying bend occurs among the nozzles 33 in the line head 28 (step S3). Then, the image processor 200 determines whether the dark ink nozzle 33 in which the flying bend occurs is present based on an acquisition result (step S4). When such a dark ink nozzle 33 is not present (step S4: FALSE), the white line does not appear, therefore the image processor 200 advances the procedure to multiple valuing processing (step S7) in order to generate the printing signal PS without any other processing. On the other hand, when the dark ink nozzle 33 in which the flying bend occurs is present (step 4: TRUE), the image processor 200 executes the following processing in order to prevent the appearance of the white line due to the flying bend.

That is, the light-ink-tone-range acquisition part 212 of the image processor 200 acquires the expressible highest tone Th indicating the expressible tone level for light ink of each color of light cyan (C1) and light magenta (M1) from the printer 2, and outputs it to the plane generator 213 (step S5).

Next, among the tone data for each of color systems of the CMYK color system received from the color converter 210, on the tone data of respective color systems of cyan (C) and magenta (M) as objects, the plane generator 213 performs plane generation processing for generating the light ink nozzle plane P1 and the dark ink nozzle plane. P2 based on the identification information of the dark ink nozzle 33 in which flying bend occurs received from the flying-bend-information acquisition part 211 and the expressible highest tone Th of the light ink received from the light-ink-tone-range acquisition part 212 (step S6).

Figure 9:
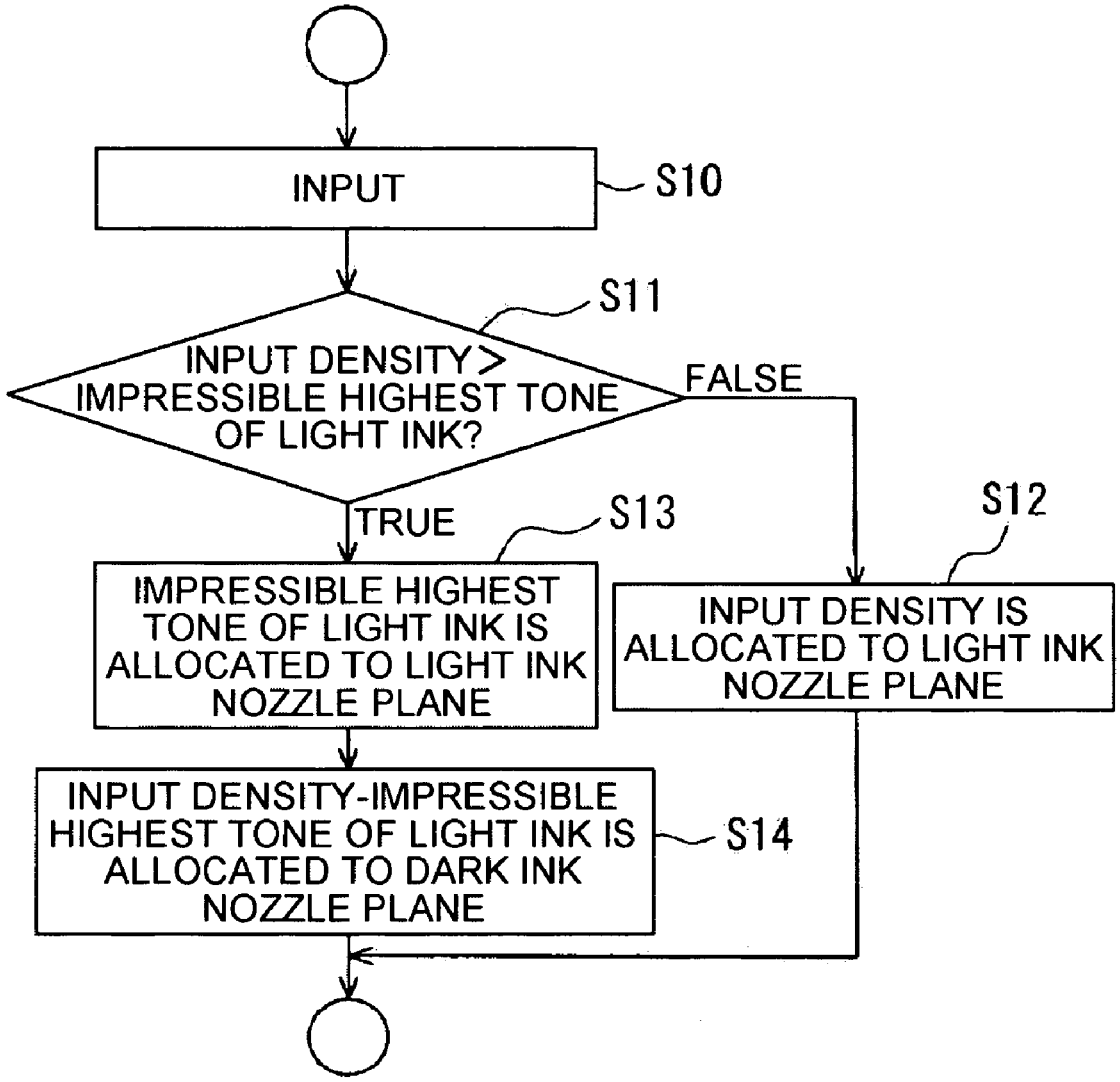
FIG. 9 is a flowchart showing the plane generation processing.

Specifically, as shown in FIG. 9, when respective tone data of cyan (C) and magenta (M) are inputted (step S10), the plane generator 213 performs the following processing on respective tone data (step S10). That is, first, the plane generator 213 identifies the pixel area A (refer to FIG. 7B) in which dots are to be formed by the dark ink nozzle 33 based on the identification information of the dark ink nozzle 33 in which the flying bend occurs, and for each of pixels in the pixel area A, determines whether the input density (tone) of the pixel is larger than the expressible highest tone Th of the light ink (step S11).

As a result of the determination, when the input density is smaller (step S11: FALSE), the plane generator 213 allocates the input density to a tone of a corresponding pixel of the light ink nozzle plane P1 without any other processing (step S12).

On the other hand, when the input density is larger (step S11: TRUE), the plane generator 213 allocates the expressible highest tone Th to a tone of a corresponding pixel of the light ink nozzle plane P1 (step S13), and allocates the insufficient tone (=input density−expressible highest tone Th) to a tone of a corresponding pixel of the dark ink nozzle plane P2 (step S14).

As a result of such plane generation processing, print of the pixel to be printed by the dark ink nozzle 33 in which flying bend occurs is allocated to the light ink nozzle 33, and only printing for the insufficient tone in printing using the light ink is allocated to the dark ink nozzle 33.

For the pixel printed by the dark ink nozzle 33 in which flying bend does not occur, input density is allocated to a corresponding pixel of the dark ink nozzle plane P2 as a tone as it is.

Then, as shown in FIG. 8, the multiple valuing part 214 receives the tone data of dark and light, ink nozzle planes P1, P2 for each of color systems of cyan (C) and magenta (M) generated by the plane generator 213, and tone data of each of color systems of yellow (Y) and black (K), and converts the data into signals that can be processed by the printer 2 (here, the multivalued signals of respective colors of C, M, Y, K, C1 and M1) (step S7). Then, the image processor 200 outputs the signals converted by the multiple valuing part 214 to the printer 2 as the printing signals PS (step S8).

Once the printer 2 receives the printing signals PS, the CPU 41 actuates the paper feed motor 25 to attract only a sheet of recording paper 3 and transfer it to a printing start position. Then, when the printing start position of the recording paper 3 is moved to a position right under the line head 28, the CPU 41 supplies the printing signals PS to the line head 28 via the head drive circuit 22 to start printing. At that time, among the printing signals PS, a signal corresponding to a light ink nozzle plane P1 of cyan (C) is supplied to the light ink nozzle 33 for discharging ink of light cyan (C1), and a signal corresponding to the dark ink nozzle plane P2 is supplied to a dark ink nozzle 33 for discharging ink of cyan (C). Similarly, a signal corresponding to a light ink nozzle plane P1 of magenta (M) is supplied to a light ink nozzle 33 for discharging ink of light magenta (M1), and a signal corresponding to the dark ink nozzle plane P2 is supplied to a dark ink nozzle 33 for discharging ink of magenta (M). Furthermore, among the printing signals PS, a signal corresponding to tone data of yellow (Y) is supplied to a dark ink nozzle 33 for discharging ink of yellow (Y), and a signal corresponding to tone data of black (K) is supplied to a dark ink nozzle 33 for discharging ink of black (K). When printing is started, the line head 28 discharges ink of C, M, Y, K, C1 and M1, and concurrently the recording paper 3 is carried intermittently in a carrying direction. As a result, a dot group corresponding to the image data generated by the computer 4 is formed on the recording paper 3.

According to the above embodiment, since the embodiment is in a configuration where the pixel in which the dots are to be formed by the dark ink nozzle 33 in which the flying bend occurs is formed by forming the dots using the light ink nozzle 33 in place of the dark ink nozzle 33, a phenomenon that the white line (banding) appears on the printed image due to the flying bend can be prevented, and accordingly the printing quality can be improved.

Moreover, even if printing is carried out using the light ink, since dot size of dots by the light ink is made to be different in accordance with a tone of an image to be printed, a situation of increase in the granular feeling of a printed image can be prevented.

Moreover, since the embodiment is in a configuration where when the tone (density) is insufficient in printing using the light ink, the dark ink is discharged from the dark ink nozzle 33 to compensate the insufficient tone, tone balance of the printed image is not disrupted; consequently a printing quality is not deteriorated. In particular, since it is in a configuration where when the tone is insufficient in printing using the light ink, the large (L) size dots are formed using the light ink, in addition, the insufficient tone is compensated by dots of the dark ink, a space is sufficiently filled up by the large (L) size dots of the light ink, and even if flying bend occurs in a dark ink nozzle 33, the white line can be made inconspicuous.

Second Embodiment

Next, a second embodiment of the invention will be described.

While the printer 2 according to the first embodiment normally performs printing using the dark ink, a printer 2 according to the embodiment is configured in a manner that it normally performs printing using both the dark ink and the light ink in accordance with a tone of a printed image.

When printing is performed using the printer 2 in such a configuration, the embodiment is same as the first embodiment in that when a flying bend occurs in a dark ink nozzle 33 that discharges the dark ink, the printing is performed using a light ink nozzle 33 that discharges the light ink, however, it is different from the first embodiment in that when the flying bend occurs in a light ink nozzle 33, printing is performed using a dark ink nozzle 33 in place of the light ink nozzle 33.

Therefore, since flying bend information is necessary on both the dark ink nozzles 33 and the light ink nozzles 33 in the embodiment, the embodiment is configured in a manner that the flying-bend-information acquisition part 211 described in the first embodiment acquires identification information of the nozzle 33 in which the flying bend occurs among respective dark ink nozzles 33 and light ink nozzles 33. The image processor 200 according to the embodiment determines whether dark or light ink is used for printing the pixel at a place where the flying bend occurs depending on which side of the dark ink nozzle 33 or the light ink nozzle 33 the flying bend occurs at.

Figure 10:
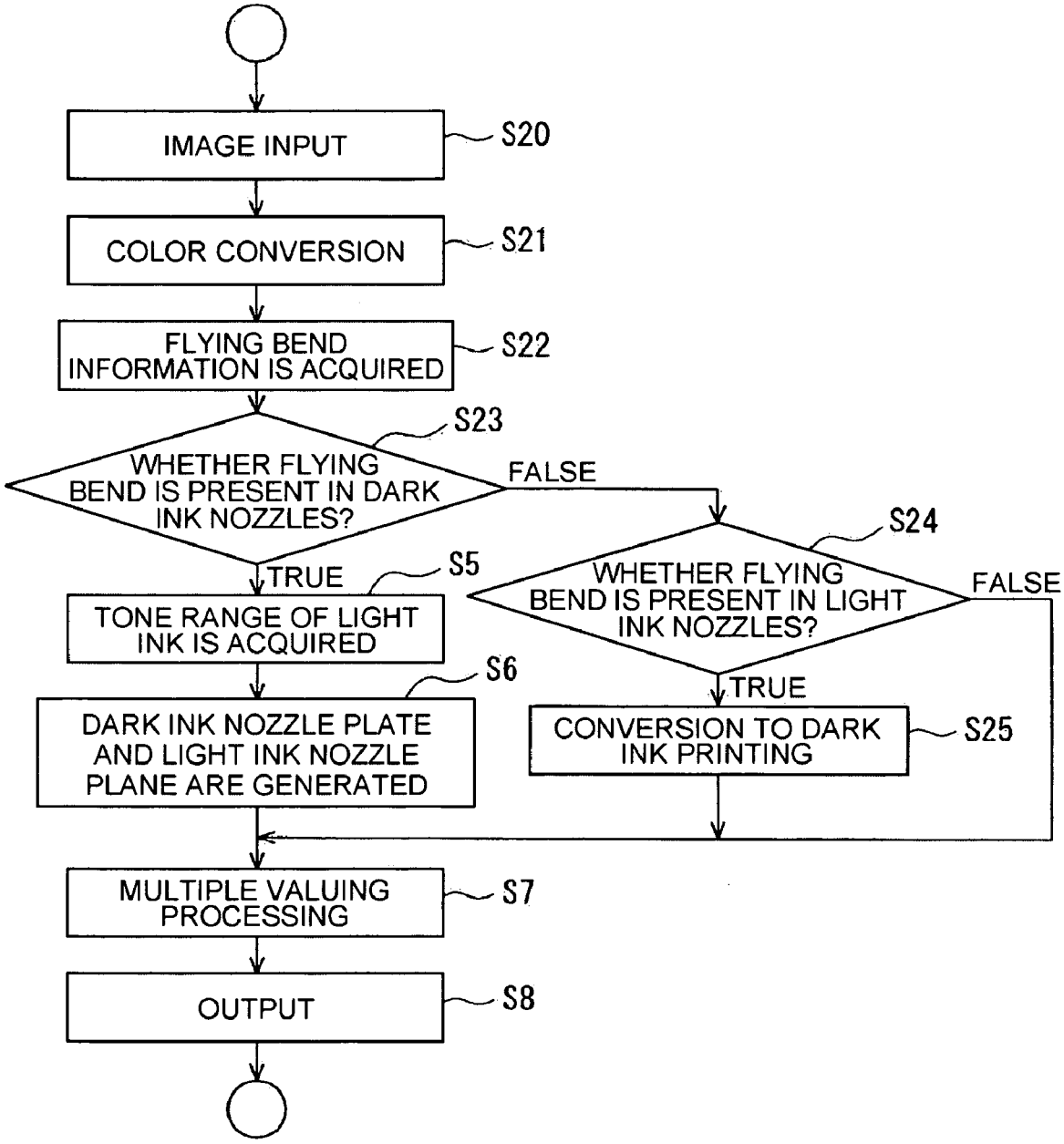
FIG. 10 is a flowchart showing image processing of a second embodiment of the invention.

Operation of an image processor 200 according to the embodiment is described in detail. As shown in FIG. 10, when image data expressed in the RGB color system is inputted into a color converter 210 (step S20), the color converter 210 converts inputted image data into tone data for each of color systems of the CMYK color system, and outputs the tone data into a plane generator 213 (step S21).

Next, the flying-bend-information acquisition part 211 acquires identification information of a dark ink nozzle 33 and a light ink nozzle 33, in which the flying bend occurs, from the printer 2 among nozzles 33 in a line head 28 (step S22).

Then, the image processor 200 determines whether a dark ink nozzle 33 in which the flying bend occurs is present (step S23), and when such a dark ink nozzle 33 is present (step S23: TRUE), in order to form dots using light ink by using a light ink nozzle 33 in place of the dark ink nozzle 33, performs plane generation processing and the like in the same manner as in the steps S5 and S6 described in the first embodiment, and then performs the aforementioned steps S7 and S8 to output printing signals PS to the printer 2.

On the other hand, when the dark ink nozzle 33 in which the flying bend occurs is not present (step S23: FALSE), the image processor 200 determines whether a light ink nozzle 33 in which the flying bend occurs is present (step S24). When the light ink nozzle 33 in which the flying bend occurs is not present (step S24: FALSE), since the flying bend does not occur, the image processor 200 advances procedure to step S7 in order to generate the printing signals PS.

When the light ink nozzle 33 in which the flying bend occurs is present (step S24: TRUE), the image processor 200 specifies a pixel area A in which dots are to be formed by the light ink nozzle 33 (refer to FIG. 7B) based on the identification information of the light ink nozzle 33 in which the flying bend occurs, and performs conversion processing so that respective pixels in the pixel area A are printed using the dark ink (step S25). As a result, printing of pixels, in which dots were to be formed by the light ink nozzle 33 in which the flying bend occurred, is allocated to a dark ink nozzle 33. At that time, since dark ink has a wide expressible tone range compared with light ink, in the case of using the dark ink, a tone of an image is not insufficient, and consequently processing for compensating a tone is not necessary.

Then, the image processor 200 generates signals that can be processed by the printer 2 through multiple valuing processing (here, multivalued signals on respective colors of C, M, Y, K, C1 and M1) (step S7), and outputs the signals to the printer as the printing signals PS (step S8).

According to the above embodiment, the effects of the first embodiment are obtained, and in addition, even if the light ink nozzle 33 in which the flying bend occurs is present, printing is carried out by a dark ink nozzle 33 in place of the light ink nozzle 33, therefore the phenomenon that the white line due to the flying bend in the light ink nozzle 33 (banding) appears on a printed image can be prevented.

While a case that the control program that has been stored in ROM 52 is executed in execution of processing shown in flowcharts of FIG. 8 to FIG. 10 has been described in each of the embodiments, it is not restrictive, and a program indicating the procedure may be loaded from a storage medium having the program recorded therein into RAM 53, and then executed. Alternatively, the program may be obtained from a network.

Here, the storage medium includes, for example, a semiconductor storage medium such as RAM and ROM, a magnetic-storage-type storage medium such as FD and HD, an optically-readable-type storage medium such as CD, CDV, LD and DVD, and magnetic-storage-type/optically-readable-type storage medium such as MO, and includes any storage medium regardless of reading methods such as electronic, magnetic, and optical methods as long as it is a storage medium that can be read by a computer.

Each of the first and second embodiments merely shows an aspect of the invention, and can be optionally modified within without departing from the scope of the invention.

For example, while the dark and light ink was used only in the color systems of cyan (C) and magenta (M) in the embodiments, a configuration where the dark and light ink is used in other color systems is also acceptable.

In addition, for example, while the computer 4 is allowed to act as the image processor 200 by incorporating the image processing program into the printer driver software installed in the computer 4 in each of the embodiments, it is not restrictive, and a configuration where the image processing program is executed by the control circuit 24 of the printer 4, thereby the control circuit 24 is allowed to act as the image processor 200 is also acceptable. In the configuration, the image processing program is previously stored, for example, in the P-ROM 43 of the control circuit 24.

Figure 11:
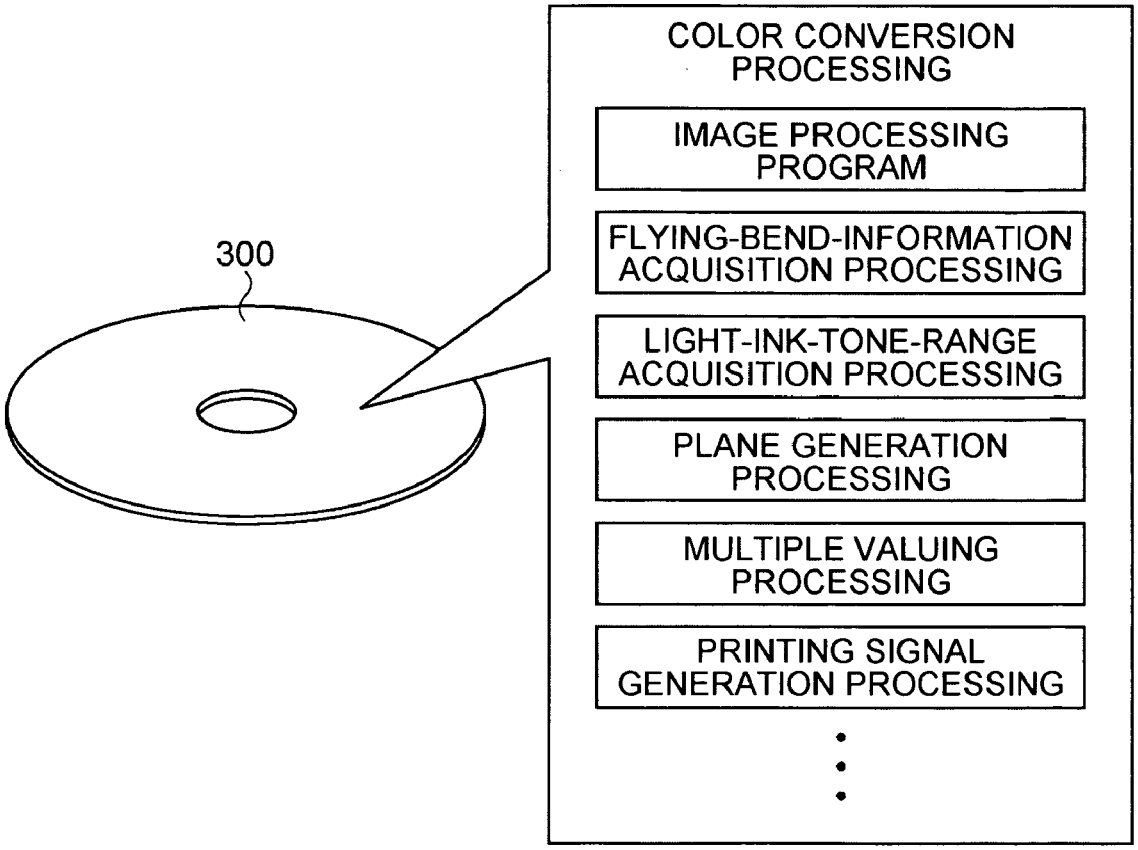
FIG. 11 is a drawing showing a recording medium having an image processing program of the invention recorded therein.

The image processing program is previously stored in the semiconductor ROM in the computer 4 or the printer 2 and incorporated into a product; in addition, it can be distributed via a network such as internet. Moreover, as shown in FIG. 11, the program can be easily provided to a request user and the like via a computer-readable recoding medium 300 such as CD-ROM, DVD-ROM and FD.

Moreover, for example, while a configuration where the expressible highest tone Th of the light ink is previously obtained and stored in the printer 2 was described in each of the embodiments, it is not restrictive. That is, it is acceptable that the light-ink-tone-range acquisition part 212 is configured to have a function of allowing the printer 2 to print a test pattern for testing a tone range of the light ink, then reading a printed test pattern by a scanner and forming it into an image, and then obtaining the expressible highest tone Th of the light ink from the image, thereby even if the expressible highest tone Th of the light ink is not, previously obtained, the light-ink-tone-range acquisition part 212 can identify the expressible highest tone Th of the light ink as needed.

Moreover, for example, while each of the embodiments is configured to use highly permeable ink as the light ink, it is not restrictive. That is, when the flying bend occurs in one of the dark ink nozzle 33 and the light ink nozzle 33, the invention suppresses the appearance of the white line by using the other nozzle 33 rather than by using permeability of the light ink, therefore ink having low permeability such as pigment ink can be used. In this way, according to the invention, the restriction of the types of usable ink is relieved; consequently a degree of freedom of usable ink can be improved.

Moreover, while each of the embodiments was made to be configured to use dark and light, two types of ink as the ink, it is not restrictive, and a configuration where N (N is a natural number of 2 or more) types of ink are used is also acceptable. In the configuration, when the flying bend occurs in a nozzle that discharges a type of ink, dots are formed using one or plural nozzle/nozzles in nozzles that discharges other types of ink among the N types of ink in place of the nozzle.

Moreover, for example, while a recording head having a configuration where a piezoelectric element is used to discharge ink is exemplified in the embodiments, a recording head that discharges ink in other methods may be used. For example, a recording head in which current, is applied to a heater disposed in an ink channel, and ink is discharged using a bubble generated within the ink channel may be used.

Moreover, for example, while an example that the invention is applied to the printer 2 that has the line head 28 as the recording head, and performs printing only by carrying the recording paper 3 in the carrying direction without scanning the recording head was described in each of the embodiments, it is not restrictive. That is, the invention can be applied to a printer in which printing is performed in a way that a recording head is mounted on a carriage, and the relevant recording head is transferred in a lateral direction relative to the recording paper 3, and concurrently ink is discharged from a nozzle in the recording head.

What is claimed is:

1. An image processor for a printer that forms an image on a medium by discharging N types (N is a natural number of at least 2) of ink having different densities for at least one color system from respective nozzles, the processor comprising:

a printing image data generator generating printing image data based on image data, a printing image data output unit outputting the printing image data, a nozzle information acquisition unit acquiring nozzle information on the nozzles, and a substitute unit that, when a bad nozzle is found in the nozzle information, substitutes another nozzle, which discharges another type of ink among the N types of ink, for the bad nozzle, wherein said another type of ink is a light ink and the type of ink designed to be discharged from the bad nozzle prior to failure of the bad nozzle is a dark ink, the nozzles capable of generating a plurality of dots having different diameters, when a light ink is used to form dots having a greater diameter, a space between the dots being filled up, when an input density of a pixel is greater than an expressible highest density of the light ink, the input density is allocated to the expressible highest density of the light ink and an insufficient density being allocated to a corresponding pixel of the dark ink.

2. The image processor according to claim 1, comprising a plane generator for generating at least one plane that defines a density value of each pixel for each type of ink, wherein regarding a first plane corresponding to a type of ink in the bad nozzle, the plane generator allocates a density value of a pixel, in which dots are formed by the bad nozzle, to a pixel corresponding to a second plane of some other type of ink.

3. The image processor according to claim 2, comprising an ink-tone-range acquisition unit that acquires a tone range that can be expressed by at least the ink corresponding to the plane allocated with the density value by the plane generator among the N types of ink.

4. The image processor according to claim 3, wherein when the density value is allocated to the other type of plane, the plane generator acquires a tone range of the ink corresponding to the plane to be allocated with the value, and when the density value exceeds a maximum density value corresponding to the tone range, the plane generator allocates a density value equivalent to a relevant, exceeded density value to the other type of plane.

5. An image processing method for a printer that forms an image on a medium by discharging N types (N is a natural number of at least 2) of ink having different densities for at least one color system from respective nozzles, the method comprising:

generating printing image data based on image data, outputting the printing image data, acquiring nozzle information on the nozzles, and when a bad nozzle is found in the nozzle information, substituting another nozzle, which discharges another type of ink among the N types of ink, for the bad nozzle, wherein said another type of ink is a light ink and the type of ink designed to be discharged from the bad nozzle prior to failure of the bad nozzle is a dark ink, the nozzles capable of generating a plurality of dots having different diameters, when a light ink is used to form dots having a greater diameter, a space between the dots being filled up, when an input density of a pixel is greater than an expressible highest density of the light ink, the input density being allocated to the expressible highest density of the light ink and an insufficient density being allocated to a corresponding pixel of the dark ink.

6. A printer comprising:

a printing image data generator generating printing image data based on image data, a printing unit forming an image on a medium by discharging N types (N is a natural number of at least 2) of ink having different densities for at least one color system from respective nozzles, a nozzle information acquisition unit acquiring nozzle information on the nozzles, and a substitute unit that, when a bad nozzle is found in the nozzle information, substitutes another nozzle, which discharges some other type of ink among the N types of ink, for the bad nozzle, wherein said some other type of ink is a light ink and the type of ink designed to be discharged from the bad nozzle prior to failure of the bad nozzle is a dark ink, the nozzles capable of generating a plurality of dots having different diameters, when a light ink is used to form dots having a greater diameter, a space between the dots being filled up, when an input density of a pixel is greater than an expressible highest density of the light ink, the input density being allocated to the expressible highest density of the light ink and an insufficient density being allocated to a corresponding pixel of the dark ink.

7. A printing method comprising:

generating printing image data based on image data, forming an image on a medium by discharging N types (N is a natural number of at least 2) of ink having different densities for at least one color system from respective nozzles based on the printing image data, acquiring nozzle information on the nozzles, and when a bad nozzle is found in the nozzle information, substituting another nozzle, which discharges another type of ink among the N types of ink, for the bad nozzle, wherein said another type of ink is a light ink and the type of ink designed to be discharged from the bad nozzle prior to failure of the bad nozzle is a dark ink, the nozzles capable of generating a plurality of dots having different diameters, when a light ink is used to form dots having a greater diameter, a space between the dots being filled up, when an input density of a pixel is greater than an expressible highest density of the light ink, the input density being allocated to the expressible highest density of the light ink and an insufficient density being allocated to a corresponding pixel of the dark ink.

8. An image processing program for allowing a computer for a printer that forms an image on a medium by discharging N types (N is a natural number of at least 2) of ink having different densities for at least one color system from respective nozzles to execute processing implemented by:

generating printing image data based on image data, outputting the printing image data, acquiring nozzle information on the nozzles, and when a bad nozzle is found in the nozzle information, substituting another nozzle, which discharges some other type of ink among the N types of ink, for the bad nozzle, wherein said some other type of ink is a light ink and the type of ink designed to be discharged from the bad nozzle prior to failure of the bad nozzle is a dark ink, the nozzles capable of generating a plurality of dots having different diameters, when a light ink is used to form dots having a greater diameter, a space between the dots being filled up, when an input density of a pixel is greater than an expressible highest density of the light ink, the input density being allocated to the expressible highest density of the light ink and an insufficient density being allocated to a corresponding pixel of the dark ink.

9. A recording medium that stores a program for allowing a computer for a printer that forms an image on a medium by discharging N types (N is a natural number of at least 2) of ink having different densities for at least one color system from respective nozzles to execute processing implemented by:

generating printing image data based on image data, outputting the printing image data, acquiring nozzle information on the nozzles, and when a bad nozzle is found in the nozzle information, substituting another nozzle, which discharges another type of ink among the N types of ink, for the bad nozzle, wherein said another type of ink is a light ink and the type of ink designed to be discharged from the bad nozzle prior to failure of the bad nozzle is a dark ink, the nozzles capable of generating a plurality of dots having different diameters, when a light ink is used to form dots having a greater diameter, a space between the dots being fitted up, when an input density of a pixel is greater than an expressible highest density of the light ink, the input density being allocated to the expressible highest density of the light ink and an insufficient density being allocated to a corresponding pixel of the dark ink.

* * * * *